US005555454A

United States Patent [19]

Dees

[11] Patent Number: 5,555,454

[45] Date of Patent: Sep. 10, 1996

[54] REMOTE SECURITY LIGHT SIGNAL ALERT SYSTEM

[76] Inventor: Kent L. Dees, 8385 Lake Ben Ave., San Diego, Calif. 92119

[21] Appl. No.: 315,822

[22] Filed: Sep. 3, 1994

[51] Int. Cl.[6] ..... G08B 5/00

[52] U.S. Cl. ..... 340/332; 340/506; 340/539; 340/531; 340/565; 340/541; 367/197; 367/198; 367/199

[58] Field of Search ..... 340/506, 539, 340/531, 197–199, 565, 541, 555, 693

[56] References Cited

U.S. PATENT DOCUMENTS

| | | | |
|---|---|---|---|
| 3,839,711 | 10/1974 | Collins et al. | 340/286 |
| 3,886,352 | 5/1975 | Lai | 250/215 |
| 3,991,415 | 11/1976 | Baar, Sr. | 340/272 |
| 4,288,784 | 9/1981 | Fusco | 340/326 |
| 4,308,911 | 1/1982 | Manoe | 165/22 |
| 4,462,022 | 7/1984 | Stolarczyk | 340/506 |
| 4,812,827 | 3/1995 | Scripps | 340/693 |
| 4,833,449 | 5/1989 | Gaffigan | 340/505 |
| 4,970,436 | 11/1990 | Sacchetti | 315/159 |
| 4,982,176 | 1/1991 | Schwarz | 340/567 |
| 4,992,701 | 2/1991 | Sacchetti | 315/159 |
| 5,019,802 | 5/1991 | Brittain et al. | 340/522 |
| 5,031,082 | 7/1991 | Bierend | 362/233 |
| 5,150,100 | 9/1992 | Black et al. | 340/555 |

OTHER PUBLICATIONS

Intelectron Product Brochure #0691–1385 4 pages.

*Primary Examiner*—Brent A. Swarthout
*Assistant Examiner*—Daryl C. Pope
*Attorney, Agent, or Firm*—John R. Flanagan

[57] ABSTRACT

A remote alert system includes an electrical signal transmitting unit located at a first location and a receiving unit located at a second location remote from the first location. The signal transmitting unit includes an electrical circuit either disposed in a module which fits between a light socket and a light bulb of a security light unit or integrated directly in the circuitry of the security light unit. The electrical circuit electrically interconnects the light socket with the light bulb so as to cause illumination of the light bulb in response to activation of the security light unit from an "off" to "on" condition. The electrical circuit also produces and broadcasts an electrical signal in response to such activation of the security light unit. The signal receiving unit includes a housing mountable at the second location and an electrical circuit disposed in the housing. The electrical circuit of the signal receiving unit receives the electrical signal broadcasted by the electrical circuit of the signal transmitting unit. The electrical circuit of the signal receiving unit also produces an alarm capable of gaining the attention of a user at the second location in response to the activation of the security light unit at the first location.

16 Claims, 2 Drawing Sheets

REMOTE SECURITY LIGHT SIGNAL ALERT SYSTEM

BACKGROUND OF THE INVENTION

1. Field of the Invention

The present invention generally relates to security light arrangements and, more particularly, is concerned with a remote security light signal alert system.

2. Description of the Prior Art

Many structures, such as residences and commercial and industrial buildings, employ some type of security arrangement to discourage and deter burglaries and intrusions. Such arrangements commonly include alarms that are activated by various types of sensing elements, surveillance television cameras and various types of fixed and/or movable lights.

Some security arrangements utilize lights that are attached on or adjacent to structures being protected. The lights are provided in fixed positions and are wired directly to a master control unit that allows the lights to be turned on or off. One such arrangement is disclosed in U.S. Pat. No. 5,031,082 to Bierend. This security arrangement utilizes a common utility power line of a building to provide communication between a master control unit and a plurality of remote lights.

Other security arrangements utilize lights that are activated by sensors of various types. For example, U.S. Pat. No. 3,886,352 to Lai discloses a security light arrangement having a pair of electric lamps whose illuminations are controlled by a daylight photocell sensor and a headlight photocell sensor. U.S. Pat. No. 3,991,415 to Baar, Sr. discloses a security arrangement having an electrical circuit interconnecting a door mat, door bell and an electric lamp such that pressure on the door mat closes an electrical circuit to the door bell and electric lamp. U.S. Pat. No. 4,288,784 to Fusco discloses a security arrangement having a security light energized and de-energized by operation of a photocell. U.S. Pat. Nos. 4,970,436 and 4,992,701 to Sacchetti disclose a security arrangement employing a motion detecting light controller which includes a passive infrared detector module with an internal power source and a light bulb socket adapter which includes a control circuit therein for a light bulb screwed into the socket adapter. The control circuit is activated by a signal received from the detector module when it detects motion in its focused area. When the control circuit is activated, the light is illuminated.

The security arrangements of the above-mentioned patents may operate adequately under the limited range of conditions for which they were designed and thus meet overall performance objectives set by their designers. However, none of these security arrangements are capable of detecting activation of a security light by a sensor and of then sending a signal to activate an alarm at a remote location to alert a user that the security light has been activated.

Consequently, a need exists for improvement of security arrangements to incorporate this highly desirable additional capability.

SUMMARY OF THE INVENTION

The present invention provides a remote security light signal alert system designed to satisfy the aforementioned need. The remote security light signal alert system of the present invention (hereinafter, for the sake of brevity, referred to as the "remote alert system") can be provided as an after-market product by having a signal transmitting unit of the system incorporated into a separate module which can be interposed between a light bulb and light socket of a security light unit. Alternatively, the signal transmitting unit of the remote alert system can be provided as part of the original equipment making up the security light arrangement by being integrated as a part of the electrical circuitry of the security light unit.

Accordingly, the present invention is directed to a remote alert system for use with a security light unit. The security light unit includes a support structure, an electrical light socket mounted on the support structure and an electrical light bulb insertable into the light socket to electrically connect therewith.

Basically, the remote alert system includes an electrical signal transmitting unit and an electrical signal receiving unit. The signal transmitting unit is connected to the security light unit and located with the security light unit at a first location. The signal transmitting unit is adapted to produce and broadcast an electrical signal in response to activation of the security light unit. The signal receiving unit is located at a second location remote from the first location and adapted to receive the electrical signal broadcasted by the signal transmitting unit at the first location and to produce an alarm signal at the second location in response to the activation of the security light unit at the first location.

In a first embodiment, the signal transmitting unit of the remote alert system includes a module mounted at the first location and having portions being adapted to electrically connect with and fit between the light bulb and the light socket of the security light unit. The signal transmitting unit also includes an electrical circuit disposed in the module. The electrical circuit has a first portion adapted to electrically interconnect the light socket with the light bulb so as to cause illumination of the light bulb in response to activation of the security light unit. The electrical circuit also has a second portion coupled to the first portion and being adapted to produce and broadcast the electrical signal in response to the activation of the security light unit and illumination of the light bulb.

In a second embodiment, the signal transmitting unit of the remote alert system is integrated with the circuitry of the security light unit and so the light bulb is then inserted directly into and electrically connected directly to the light socket.

The electrical signal receiving unit of the remote alert system includes a housing mountable at the second location and an electrical circuit disposed in the housing. The electrical circuit in the signal receiving unit has a first portion adapted to receive the electrical signal broadcasted by the second portion of the electrical circuit of the signal transmitting unit at the first location. The electrical circuit also has a second portion coupled to the first portion and being adapted to produce the alarm signal capable of gaining the attention of a user at the second location in response to the first portion receiving the electrical signal broadcasted by the signal transmitting unit as a result of activation of the security light unit at the first location remote from the second location.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 5:
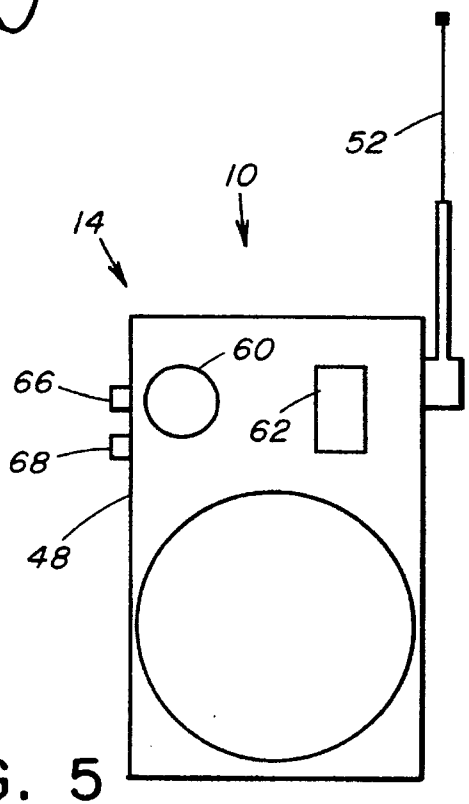
FIG. 5 is a side elevational view of an electrical signal receiving unit of the remote alert system of the present invention, being disposed at a location remote from that of the electrical signal transmitting unit of the remote alert system.
Figure 1:
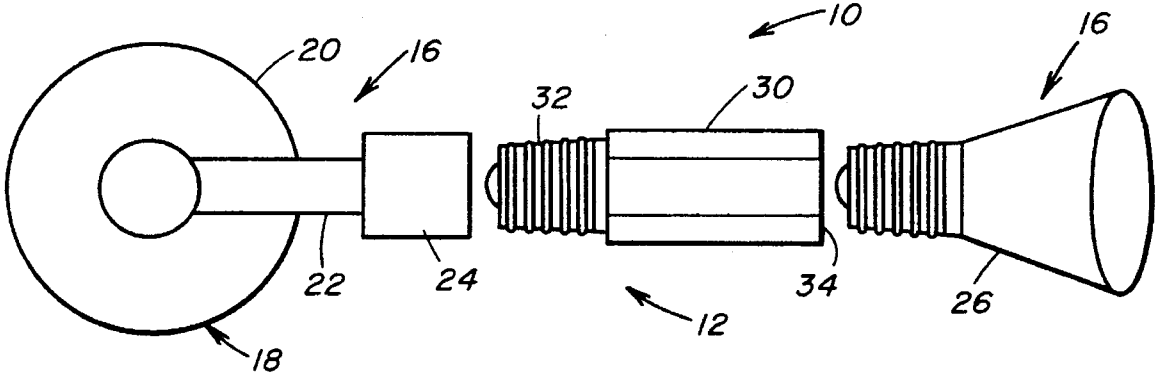
FIG. 1 is a side elevational view of a first embodiment of the electrical signal transmitting unit of the remote alert system of the present invention, being disposed between a light bulb and a light socket of a security light unit.
Figure 3:
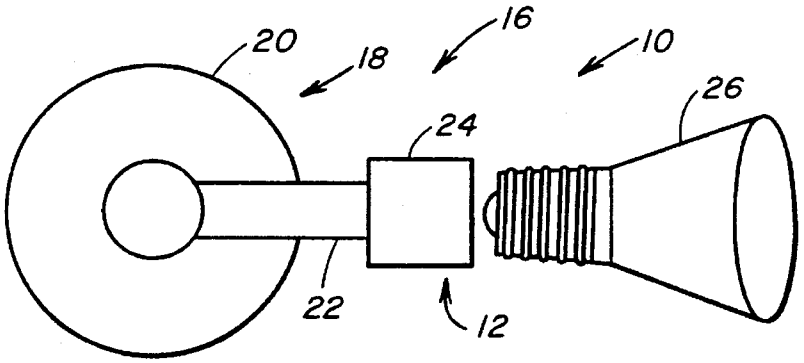
FIG. 3 is a side elevational view of a second embodiment of the electrical signal transmitting unit of the remote alert system of the present invention, being incorporated into the security light unit.

Referring to the drawings and particularly to FIGS. 1, 3 and 5, there is illustrated a remote alert system of the present invention, being generally designated 10. Basically, the remote alert system 10 includes an electrical signal transmitting unit 12 and an electrical signal receiving unit 14. The signal transmitting unit 12 employed with a conventional security light unit 16 located at a first location, such as on a pole or on the exterior of a building. The signal transmitting unit 12 is adapted to produce and broadcast or transmit an electrical signal in response to activation of the security light unit 16. The signal receiving unit 14 is located at a second location, such as at an office or residence or carried on the person of a user, being remote from the first location and is adapted to receive the electrical signal broadcasted by the signal transmitting unit 12 at the first location and to produce an alarm signal, such as audible, visual and/or vibratory signals, at the second location in response to the activation of the security light unit 16 at the first location. The signal receiving unit 14 can be installed at a fixed location or can be portable, like a pager, which is carried on the person of the user.

Referring to FIGS. 1 and 3, the conventional security light unit 16 includes a support structure 18 such as a housing 20 and an elongated arm 22 extending outwardly from the housing 20, an electrical light socket 24 mounted on the outer end of the elongated arm 22 and an electrical light bulb 26 insertable into the light socket 24. The elongated arm 22 has a hollow interior for routing electrical conductors (not shown) from a suitable electrical source, through the housing 20 and an elongated arm 22, to the electrical light socket 24 to electrically connect therewith. The conventional security light unit 16 is activated from an "off" (non-illuminated) condition to an "on" (illuminated) condition in any suitable known manner, such as by an infrared or motion sensing detector (not shown), electrically connected to the electrical controls (not shown) of the security light unit 16. The infrared or motion sensing detector senses the presence or movement of an intruder within the active detection zone of the security light unit 16. At a preset period of time after the sensing ceases, the unit 16 will automatically deactivate and return to the "off" condition. An example of a suitable security light unit which can be used is the one disclosed in U.S. Pat. Nos. 4,970,436 and 4,992,701 to Sacchetti, the disclosure of which is incorporated herein by reference.

Figure 2:
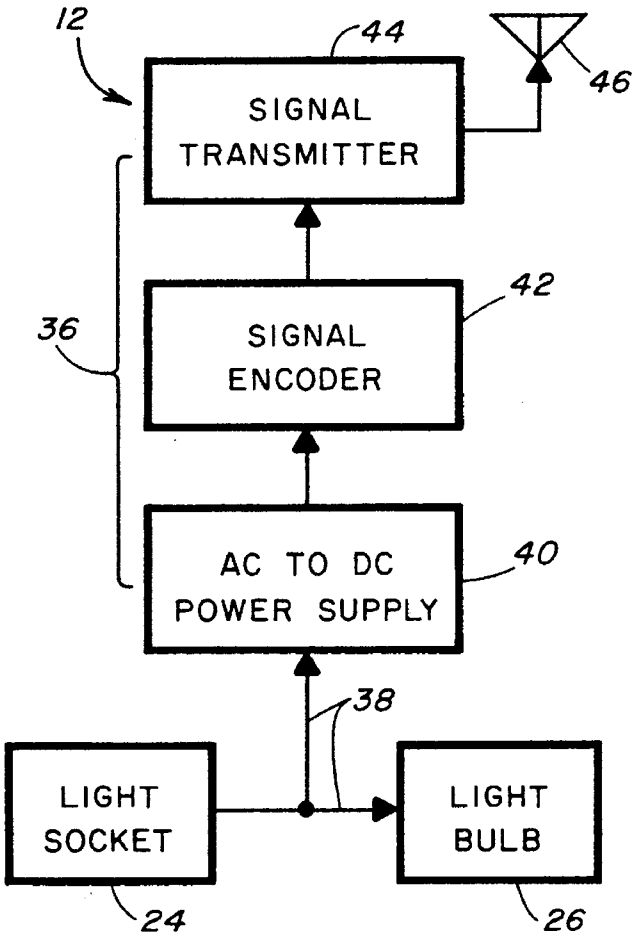
FIG. 2 is a block diagram of the electrical signal transmitting unit of FIG. 1.

Referring to FIGS. 1 and 2, in a first embodiment the signal transmitting unit 20 includes a module 30 mounted at the first location and having opposite plug and socket portions 32, 34 adapted to electrically interconnect with and removably interfit between the light socket 24 and the light bulb 26 of the security light unit 16. The signal transmitting unit 20 also includes an electrical circuit 36 disposed in the module 30. The electrical circuit 36 has an electrical conductor 38 in the module 30 electrically interconnecting the light socket 24 with the light bulb 26 to cause illumination of the light bulb 26 in response to activation of the security light unit 16, such as by an intruder as described above. The electrical circuit 36 also includes an AC to DC power supply 40, an encoder or electrical signal generator 42, a signal transmitter 44 and an antenna 46 connected in series with one another. The power supply 40 is connected to the electrical conductor 38. The power supply 40, signal generator 42, signal transmitter 44 and antenna 46 are operable to produce and broadcast an encoded electrical signal in response to the activation of the security light unit 16 which caused illumination of the light bulb 26. An example of a suitable commercial component that can provide the signal generator 42, signal transmitter 44 and antenna 46 of the signal transmitting unit 12 is an RF encoder/transmitter identified by the product designation TX-99K and marketed by MING Engineering & Products, Inc.

Figure 4:
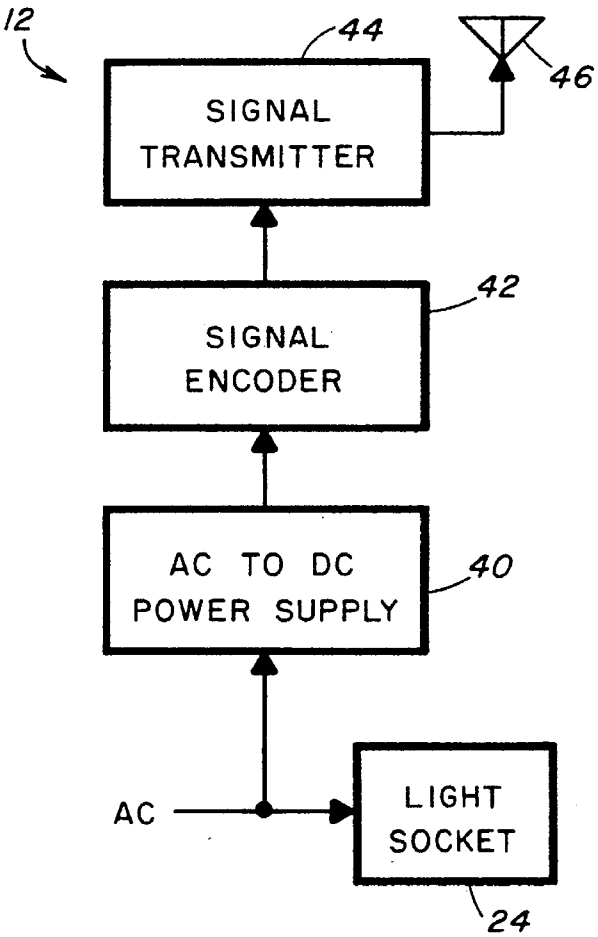
FIG. 4 is a block diagram of the electrical signal transmitting unit of FIG. 3.

Referring to FIGS. 3 and 4, in a second embodiment the signal transmitting unit 12 is substantially the same as in the first embodiment, except that the module 30 is now omitted. The electrical circuit 36 of the signal transmitting unit 12 is now integrated with the circuitry of the security light unit 16 such that now the light bulb 26 is inserted directly into light socket 24 and thus is electrically connected directly to the light socket 24.

Figure 6:
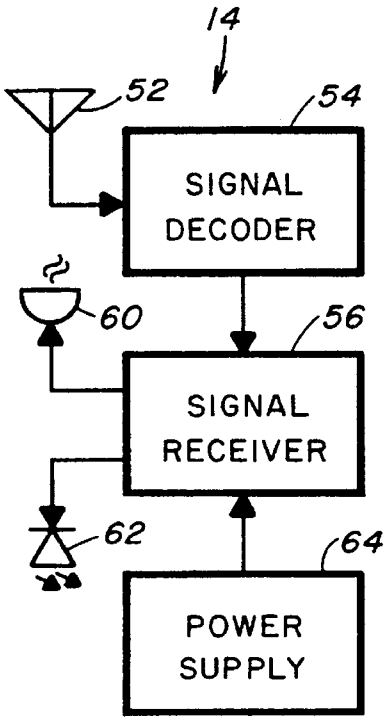
FIG. 6 is a block diagram of the electrical signal receiving unit of FIG. 5.

Referring to FIGS. 5 and 6, the signal receiving unit 14 of the remote alert system 10 includes a casing or housing 48 mounted at the second location and an electrical circuit 50 disposed in the housing. The electrical circuit 50 in the signal receiving unit 14 has an antenna 52, a signal decoder 54, and a signal receiver 56 connected in series and a pair of alerting devices in the form of an audio alarm 60 and a visual alarm 62 electrically connected in parallel to the signal receiver 56. Also, the electrical circuit 50 includes a power supply 64, such as batteries or a source of AC power, connected to the signal receiver 56. The antenna 52, signal decoder 54 and signal receiver 56 are adapted to receive the electrical signal broadcasted from the antenna 46 of the electrical circuit 36 of the signal transmitting unit 12 at the first location. The alarms 60, 62 are activated by the signal receiver 56 to produce alarm signals capable of gaining the attention of a user at the second location. Thus, the alarm signals are produced in response to the activation of the security light unit 16 at the first location remote from the second location. An example of a suitable commercial component that can provide the antenna 52, signal decoder 54 and signal receiver 56 of the signal receiving unit 14 is an RF decoder/receiver identified by the product designation RE-99 and marketed by MING Engineering & Products, Inc. The signal generator or encoder 42 and the signal decoder 54 are preset and operable to provide an unique signal so that the remote alert system 10 will not conflict with other electrical devices in the area, such as garage door openers and the like. The unique signal can be of the type set the user or can be of the type which is installed at the factory and not changed by the user. Also, the signal receiving unit 14 has an on/off switch 66 and a reset button 68 which allows turning off of the alarm without affecting the light. Finally, the respective antennas 46, 52 can be either internally or externally mounted on the respective units 12, 14.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A remote security light signal alert system for use with a security light unit activatable between "on" and "off" conditions, said system comprising:

(a) an electrical signal transmitting unit for electrical connection to the security light unit and having electrical means for producing and broadcasting an electrical signal in response to activation of the security light unit by detecting movement or presence by a detector which causes activation of a light bulb thereof from an "off" to "on" condition, said electrical signal transmitting unit being a module separate from said security light unit and having opposite plug and socket portions for interfitting said module between and interconnecting said module with a light socket and the light bulb of the security light unit, said plug portion of said module being configured to removably interfit with and be received in the light socket of the security light unit, said socket portion of said module being configured to removably interfit with and receive the light bulb of the security light unit; and (b) an electrical signal receiving unit separate from the electrical signal transmitting unit and security light unit and having electrical means for receiving said electrical signal broadcasted by said electrical means of said signal transmitting unit and for producing an alarm signal in response to the activation of the security light unit thereby indicating movement or presence detected which causes the activation of the light bulb thereof to the "on" condition.

2. The system of claim 1 wherein said electrical means of said signal transmitting unit is an electrical circuit having an electrical signal generator for producing an electrical signal in response to the activation of the security light unit to the "on" condition, and a signal transmitter and an antenna connected in series with one another and with said electrical signal generator for receiving and broadcasting the electrical signal produced by said electrical signal generator.

3. The system of claim 2 wherein said electrical signal generator is a signal encoder.

4. The system of claim 2 wherein said electrical circuit also has an electrical conductor in said module electrically interconnecting the light socket with the light bulb at said portions of said module to cause illumination of the light bulb in response to activation of the security light unit to the "on" condition.

5. The system of claim 2 wherein said electrical circuit also has an AC to DC power supply connected to said signal generator.

6. The system of claim 1 wherein said electrical means of said signal receiving unit is an electrical circuit having at least one alerting device and an antenna and a signal receiver connected in series with one another and with said alerting device for receiving said electrical signal broadcasted by said signal transmitting unit and in response to said receipt of said electrical signal to activate said alerting device to produce an alarm signal for gaining the attention of a user.

7. The system of claim 6 wherein said alerting device is an audio alarm.

8. The system of claim 6 wherein said alerting device is a visual alarm.

9. The system of claim 6 wherein said electrical circuit also has a power supply connected to said signal receiver.

10. The system of claim 6 wherein said electrical circuit also has a signal decoder connected between said antenna and signal receiver.

11. In combination with a security light unit having a support, at least one electrical light socket mounted to said support and at least one electrical light bulb insertable into said light socket to electrically connect therewith, said security light unit activatable from an "off" to "on" condition to cause illumination of said light bulb, a remote alert system comprising:

(a) an electrical signal transmitting module separate from said security light unit and including a pair of opposite plug and socket portions interfitting said module between said light socket and light bulb of said security light unit and an electrical circuit disposed in said module between and connected to said opposite plug and socket portions of said module, said plug portion of said module being configured to removably interfit with and be received in said light socket of said security light unit, said socket portion of said module being configured to removably interfit with and receive said light bulb of said security light unit, said electrical circuit having a first portion electrically interconnecting with said security light unit for causing illumination of said light bulb, with said module interfitted between said light socket and said light bulb of said security light unit, in response to activation of said security light unit by detecting movement or presence by a detector which causes activation of said light bulb thereof from said "off" to "on" condition, said electrical circuit having a second portion coupled to said first portion for producing and broadcasting an electrical signal in response to said activation of said security light unit which causes the activation of said light bulb thereof from said "off" to "on" condition producing said illumination of said light bulb; and (b) an electrical signal receiving unit disposed at a second location separated from a first location of said electrical signal transmitting module and security light unit, said electrical signal receiving unit including an electrical circuit having a first part for receiving said electrical signal broadcasted by said second portion of said electrical circuit of said electrical signal transmitting module and a second part coupled to said first part for producing an alarm for gaining the attention of a user at said second location in response to said first part receiving said electrical signal broadcasted by said electrical signal transmitting module as a result of activation of said security light unit thereby indicating movement or presence detector which causes activation of said light bulb thereof at said first location from said "off" to "on" condition.

12. The system of claim 11 wherein said second portion of said electrical circuit of said signal transmitting module has an electrical signal generator for producing an electrical signal in response to said activation of the security light unit to the "on" condition, and a signal transmitter and an antenna connected in series with one another and with said electrical signal generator for receiving and broadcasting the electrical signal produced by said electrical signal generator.

13. The system of claim 12 wherein said electrical signal generator is a signal encoder.

14. The system of claim 11 wherein said first portion of said electrical circuit of said signal transmitting module is an electrical conductor in said module electrically interconnecting said light socket with said light bulb at said opposite plug and socket portions of said module to cause said illumination of said light bulb in response to said activation of said security light unit.

15. The system of claim 11 wherein said first part of said electrical circuit of said signal receiving unit has at least one alerting device and an antenna and a signal receiver connected in series with one another and with said alerting device for receiving said electrical signal broadcasted by said signal transmitting unit and in response to said receipt of said electrical signal to activate said alerting device to produce an alarm signal for gaining the attention of a user.

16. The system of claim 15 wherein said first part of said electrical circuit of said signal receiving means is a signal decoder disposed between said antenna and signal receiver.

* * * * *